United States Patent [19]

Haase et al.

[11] Patent Number: 4,955,526

[45] Date of Patent: Sep. 11, 1990

[54] BUSINESS FORM SUCH AS AN ENVELOPE

[75] Inventors: Roger L. Haase, Arlington Hts.; Gary W. Fitzgibbons, Prairie View, both of Ill.

[73] Assignee: Uarco Inc., Barrington, Ill.

[21] Appl. No.: 317,464

[22] Filed: Mar. 1, 1989

[51] Int. Cl.[5] ..... B65D 27/10; B65D 27/34

[52] U.S. Cl. ..... 229/69; 206/610

[58] Field of Search ..... 229/69; 206/610, 611, 206/632, 634

[56] References Cited

U.S. PATENT DOCUMENTS

| | | | |
|---|---|---|---|
| 3,104,799 | 9/1963 | Steidinger | 229/69 |
| 3,339,827 | 9/1967 | Steidinger | 229/69 |
| 3,411,699 | 11/1968 | Pine et al. | 229/69 |
| 3,552,641 | 1/1971 | Bell et al. | 229/69 |
| 3,554,438 | 1/1971 | Van Maldergham | 229/69 |
| 3,905,545 | 9/1975 | Juszak et al. | 229/69 |
| 3,941,308 | 3/1976 | DiGirolomo et al. | 229/69 |
| 4,157,759 | 6/1979 | Dicker | 229/69 |
| 4,346,916 | 8/1982 | Shelton | 229/69 |
| 4,418,865 | 12/1983 | Bowen | 229/69 |
| 4,511,042 | 4/1985 | Wischusen, III | 206/611 |
| 4,586,611 | 5/1986 | Scalzo | 229/69 |
| 4,645,123 | 2/1987 | Ashby | 229/69 |
| 4,671,454 | 6/1987 | Warren | 229/69 |
| 4,705,298 | 11/1987 | Van Maldergham | 229/69 |
| 4,729,506 | 3/1988 | Neubauer | 229/69 |
| 4,741,475 | 5/1988 | Norman | 229/69 |
| 4,744,508 | 5/1988 | Fowler et al. | 229/69 |
| 4,747,535 | 5/1988 | Haase et al. | 229/69 |
| 4,770,337 | 9/1988 | Leibe | 229/69 |
| 4,776,510 | 10/1988 | Jenkins | 229/69 |
| 4,824,142 | 4/1989 | Dossche | 229/69 |

FOREIGN PATENT DOCUMENTS

| | | | |
|---|---|---|---|
| 2123258 | 11/1971 | Fed. Rep. of Germany | 206/612 |
| 2917795 | 8/1980 | Fed. Rep. of Germany | 206/620 |
| 0615209 | 4/1926 | France | 206/610 |
| 536595 | 12/1955 | Italy | 206/610 |

*Primary Examiner*—Stephen P. Garbe

*Attorney, Agent, or Firm*—Wood, Phillips, Mason, Recktenwald & VanSanten

[57] ABSTRACT

An envelope assembly 12 including a front 22 and a back 24 joined together by adhesives 38, 52, 54, 58, 60, 62 and 64 form a pocket and a tear strip 124 in the back 24 for opening the envelope and achieving access to the pocket including an elongated line 110 of adjacent Y-shaped cuts 112 in the back 24 with the base 114 of each Y-shaped cut 112 terminating at a location between the arms 116 of an adjacent Y-shaped cut 112, and an elongated slit 118 in the back 24 and intersecting the line 110.

9 Claims, 2 Drawing Sheets

BUSINESS FORM SUCH AS AN ENVELOPE

FIELD OF THE INVENTION

This invention relates to business forms generally, and more particularly to envelope assemblies, as, for example, continuous business forms made up of stuffed, sealed envelope assemblies as well as to multiple ply or sheet business forms.

BACKGROUND OF THE INVENTION

The first stuffed, sealed, continuous business form assembly that allowed easy extraction of contents that were printed while within the envelope is disclosed is commonly assigned (U.S. Pat. No. 3,104,799 issued to D. J. Steidinger on Sept. 24, 1963. The advent of the Steidinger form created a whole new field of business forms that were particularly well suited for large scale mailings of individualized information.

Because business forms of this sort have been so successful, a large number of variations on the basic form devised by Steidinger have been proposed. One such proposal is contained in commonly assigned U.S. Pat. No. 4,747,535 issued May 31, 1988 to Haase et al. The structure disclosed in the Haase et al patent relates specifically to a so-called "two-way" envelope, although the principles of the same are not limited to such envelopes. In that construction, part of the original envelope is removed by the recipient to expose a flap which may then be folded over the remainder of the original envelope to provide a return envelope. A unique means of opening the Haase et al envelope and/or free insert material within the pocket of the envelope are features of the Haase et al invention.

The structure of the Haase et al invention works well generally for its intended purpose. However, part of the means defining a tear strip for achieving access to the contents of the original envelope do not operate as postively as might be desired. In addition, the means by which removal of the tear strip free the contents of the original envelope requires great care in manufacture or else such means may not operate with the high degree of reliability that is desired in forms of this type.

The present invention is directed to overcoming one or more of the above problems and, even more broadly, to provide a) improved tear strips, and b) easily releasable, adherance of two or more ply receipts together in continuous business forms.

SUMMARY OF THE INVENTION

It is the principal object of the invention to provide a new and improved assembly of two or more sheets or plies, such as a business form or an envelope.

According to one facet of the invention, the foregoing objects are realized in a structure serving as an envelope assembly that includes a front and a back joined together to form a pocket. A tear strip is located in one or the other of the front or the back for opening the envelope and achieving access to the pocket. The tear strip includes an elongated line of adjacent Y-shaped cuts in the appropriate one of the front and back of the envelope with the base of each Y-shaped cut terminating at a location between the arms of an adjacent Y-shaped cut. An elongated slit is located in the appropriate one of the front and the back and intersects the line of cuts to thereby provide a tab that may be grasped to initiate tearing.

According to a preferred embodiment of this facet of the invention, the slit is generally at right angles to the line of cuts. In a highly preferred embodiment, the front and back of the assembly are at least in part secured together by a line of releasable adhesive that is generally parallel to the line of cuts and the slit extends between the line of releasable adhesive and the line of cuts. The lines together then define the tear strip.

According to this facet of the invention, the Y-shaped form of the cuts provides a structure wherein a tear along the line is not prone to wander off of the line.

According to another facet of the invention, one or more of the foregoing objects is achieved in a continuous business form envelope assembly including top and bottom elongated plies defining the fronts and backs of a series of connected envelopes. At least one intermediate, elongated ply is located between the top and bottom plies and defines insert material within each of the series of connected envelopes. The intermediate ply is die cut at intervals along its length to define openings through which adhesive may extend to join the top and bottom plies and define upper and lower individual envelope edges. One longitudinal marginal edge of the intermediate ply is adhered to the top and bottom plies along a corresponding longitudinal marginal edge thereof and at least one line of perforation extends across the bottom ply to define a tear strip that may be removed to partly expose the intermediate ply. One end of the tear strip is adhered to part of the longitudinal marginal edge of the intermediate ply and the other side of such part is adhered to the top ply via a less porous material on the latter. The aforementioned part of the longitudinal marginal edge of the insert ply is separated from the remainder of such edge by a line of weakening and connected to the remainder of the intermediate ply by one or more frangible connections which serve to register the remainder of the intermediate ply between the top and bottom plies. The remainder of the intermediate ply is otherwise free of connections to the one longitudinal marginal edge so that removal of the tear strip from the envelope will remove the part of the intermediate ply adhered thereto by reason of it being adhered to the tear strip and only weakly adhered to the top ply because of the less porous material and will thereby rupture the frangible connection and expose and free the insert material within the envelope for extraction therefrom.

In a preferred embodiment of the invention, hot spot carbon material is disposed on the top ply and faces the intermediate ply to provide for image transfer to the intermediate ply upon impact printing. The less porous material to which the intermediate ply is adhered by the part that is secured to the tear strip is hot spot carbon so as to avoid the need for different types of adhesive and make use of the fact that the application of hot spot carbon for image transfer purposes can also be utilized to provide a relatively weak adhesive bond.

It is also desirable according to this embodiment of the invention that the line of perforation by defined by a series of aligned, Y-shaped cuts and that such line be intersected by a slit in the bottom ply to define the tear strip.

According to still another facet of the invention, one or more of the foregoing objects is achieved in a multiple ply business form having first and second superimposed plies or sheets of paper, hot spot carbon on the side of the first ply or sheet facing the second ply or sheet and including an area whereby images impacted on the first ply or sheet will be transmitted to the second ply or sheet, and adhesive releasably joining at least parts of the first and second plies or sheets at a location remote from the area containing the hot spot carbon. According to this facet of the invention, there is provided the improvement wherein additional hot spot carbon is placed on the side of the first ply or sheet facing the second ply or sheet at the location of the adhesive and the adhesive extends between the additional hot spot carbon and the second ply or sheet to form a weak, releasable bond thereat.

This facet of the invention, in a preferred embodiment, contemplates that the adhesive extend directly between the first and second plies or sheets at points other than the location of the hot spot carbon to form a strong adhesive bond at such points.

Other objects and advantages will become apparent from the following specification taken in connection with the accompanying drawings.

DESCRIPTION OF THE PREFERRED EMBODIMENT

Figure 1:
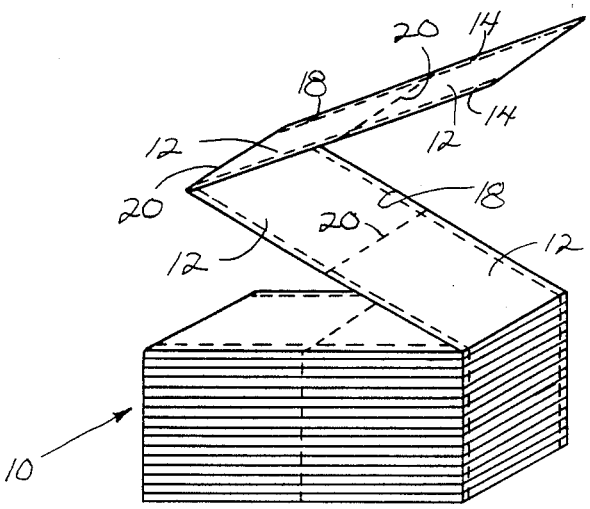
FIG. 1 is a perspective view of a zig-zag folded stack of an embodiment of the invention in the form of a continuous business form assembly.

An exemplary embodiment of a business form made according to the invention is illustrated in the drawings in the form of a continuous business form envelope assembly and that is its preferred use. However, as will be seen, certain facets of the invention are not limited to envelope assemblies or continuous business forms. In any event, as illustrated in FIG. 1, there is a zig-zag folded stack, generally designated 10, made up of a series of connected envelopes 12. The resulting continuous business form assembly has control punch margins 14 on opposite longitudinal edges which includes so-called pin feed holes 16 (FIGS. 4 and 5) and which typically are separated from the remainder of the form by lines of weakening 18 such as perforations.

The individual envelopes in the assembly are delimited by crosslines of perforation 20 and in the form of the invention illustrated in FIG. 1, the continuous business form is folded on every other crossline of perforation 20.

Figure 2:
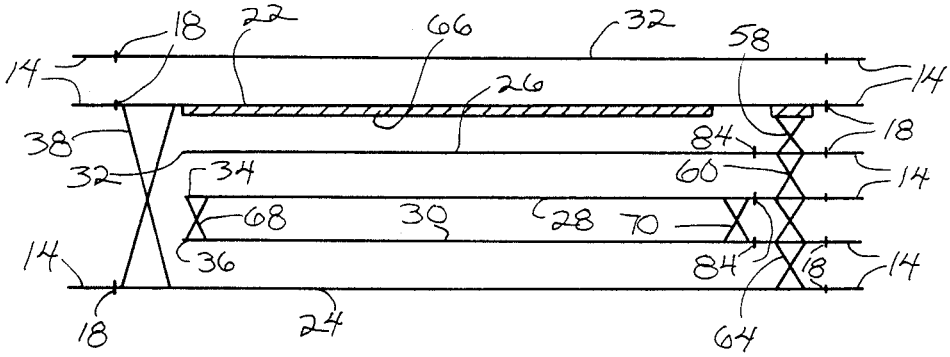
FIG. 2 is a somewhat schematic sectional view of the form taken across the form, that is, from one longitudinal edge to the other.
Figure 3:
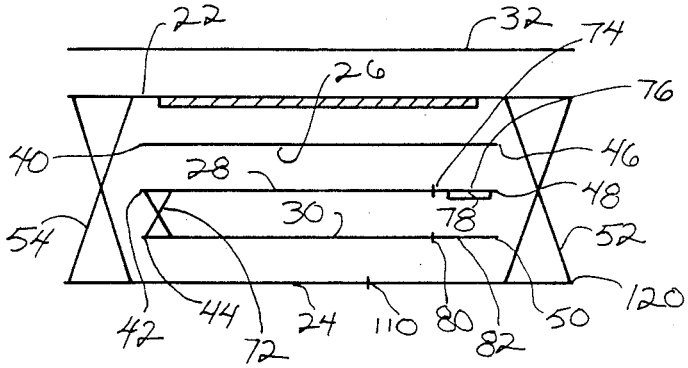
FIG. 3 is a somewhat schematic cross-sectional view of one envelope made according to the invention taken from top to bottom of the form.

The make-up of typical embodiments of individual envelopes 12 can be ascertained in part from FIGS. 2 and 3. Each includes an upper ply 22 and a bottom ply 24, both of paper. Where the business form is an envelope, the upper ply 22 will typically constitute the front of the envelope while the bottom ply 24 will constitute the back. Within each envelope is one or more inserts defined by one or more intermediate plies of paper. In the illustrated embodiment, three such intermediate plies are shown at 26, 28 and 30.

Frequently, but not always, a so-called record ply 32 is superimposed over the top ply 22 for the purposes stated in the previously identified Steidinger patent.

As can be seen in FIG. 2, the left-hand longitudinal edges of the insert plies 26, 28 and 30 are shown at 32, 34 and 36 respectively. The same stop short of the line of perforation 18 defining in part the control punch margin 14 on the left-hand longitudinal edges of the plies 22, 24 and 32. A longitudinal line of glue shown schematically as at 38 extends between the plies 22 and 24 and past the edges 32, 34 and 36 without contacting the plies 26, 28 and 30 to adhere the front and the back of the envelope together along their left-hand margin while leaving the insert material unattached thereto. Similarly, as can be seen in FIG. 3, bottom edges 40, 42 and 44 as well as top edges 46, 48 and 50 respectively of the plies 26, 28 and 30 are located inwardly of longitudinally extending top and bottom glue lines 52 and 54 interconnecting the plies 22 and 24.

Thus, the insert material defined by the plies 26, 28 and 30 is free from connection to the interior of the envelope defined by the plies 22 and 24 on three marginal edges.

The edges 40, 42, 44, 46, 48 and 50 are defined by die cuts that extend longitudinally across the intermediate plies 26, 28 and 30 to allow placement of the glue lines 38, 52 and 54 in the manner disclosed in the previously identified Steidinger patent, the details of which are herein incorporated by reference. That is to say, die cuts define the individual inserts within each envelope.

Figure 4:
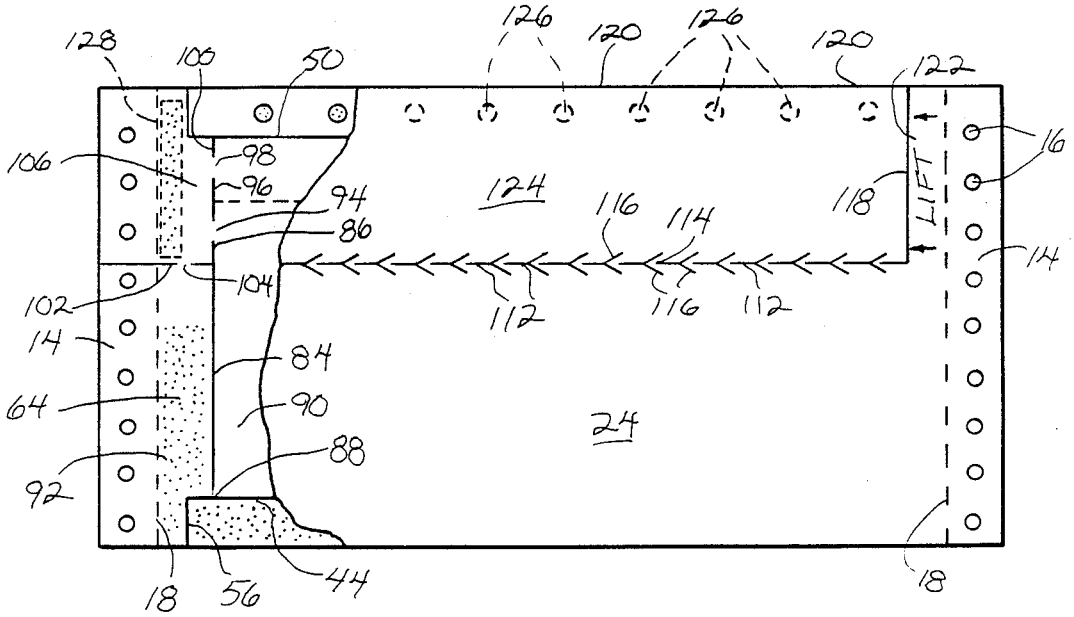
FIG. 4 is a plan view of the back of one form length of envelope assembly made according to the invention with parts broken away for clarity.

On the fourth side, the insert plies 26, 28 and 30 are continuous from one form length to the next as can be ascertained from FIG. 4, noting that each die cut stops short of the line of perforation 18 at an end 56. In this area, longitudinally extending glue lines 58, 60, 62 and 64 respectively adhere the plies 22 and 26, the plies 26 and 28, the plies 28 and 30 and the plies 30 and 24 along their right-hand longitudinal margins.

Thus, the various glue lines heretofore described define a sealed envelope housing insert material in the form of the plies 26, 28 and 30. The latter are attached to the envelope along their right-hand marginal edges by reason of the glue lines 58, 60, 62 and 64. As is well known, the presence of these glue lines maintains insert material in a desired position of registry within the resulting sealed envelope. In this connection, impact printing is frequently applied to the record ply 32 or in some instances, to the top ply 22. Parts of the impact printing are desirably printed on at least a ply 26 and according to one facet of the invention, to assure that any image impacted on the ply 32 or the ply 22 will be transferred to the ply 26, the side of the ply 22 facing the ply 26, in predetermined areas, is coated with conventional hot spot carbon 66. The hot spot carbon 66 is conventional in the art and is applied to the appropriate side of the ply 22 in a conventional fashion. Alternatively, known CF-CB or CFB systems at the interface of the plies 22 and 26 may be used.

Typically, it is desired that the insert plies 28 and 30 form a return envelope. To this end, longitudinal edges of those plies within the basic envelope are connected by glue lines 68 and 70, the latter being within the glue line 62. As seen in FIG. 3, a transverse glue line 72 is also provided between the plies 28 and 30 adjacent their edges 42 and 44 to define the bottom of the envelope. A line of weakening 74 in the ply 28 defines a foldable flap 76 for the return envelope which is provided with remoistenable adhesive 78 on its side facing the ply 30.

A line of weakening 80 in the ply 30 generally aligned with the line of weakening 74 defines a removable chip 82 that can be removed by the recipient so as to allow the flap 78 to be folded over the ply 30.

As seen in FIG. 2, lines of weakness 84, which may all be identical, are located in the plies 26, 28 and 30 just inwardly of the lines of adhesive 58, 60, 62 and 64. As seen in FIG. 4, each such line of weakness 84 is defined by an elongated slit that extends from a point 86 to a point 88. This slit is continuous which is to say it completely severs the vast majority 90 of the corresponding ply 26, 28 or 30 from a stub 92 which includes the continuous portion of each intermediate ply.

At the point 86, the slit is interrupted by a small tie 94. The line of weakness 84 then continues with a relatively short slit 96 followed by another tie 98 and finally a small slit 100 extending to the edge 50. The ties 94 and 98 are quite small but are sufficient to maintain the portions 90 of the intermediate plies 26, 28 and 30 in registry at the desired position within the interior of the envelope. At the same time, they are readily broken so as to free the insert material.

Just below the tie 94 the stub 92 is provided with a transverse line of weakening 102 which may be a slit including a small tie 104. The tie 104 is similar to the ties 94 and 98 and as a consequence of its presence, a part 106 of the stub 92 may be separated from the remainder simply by rupture of the tie 104.

As seen in FIG. 3, a line of perforation 110 extends transversly across the back or bottom ply 24. This line is illustrated in FIG. 4 as a series of Y-shaped cuts 112 in the ply 24. It is to be particularly noted that the base 114 of each Y-shaped cut 112 terminates at a location between the arms 116 of the next adjacent cut 112. It is also to be noted that the bases 114 extend in the direction upon which the line 110 is intended to be torn, in FIG. 4, from right to left.

Near the right-hand margin, a continuous slit 118 is located in the ply 24 and the same extends at right angles to the line 110 to intersect the same and to intersect the top edge 120 of the bottom ply 24. Indicia 122 in the form of an instruction may be provided instructing the recipient to grasp the tear strip 124 defined by the line 110 and the edge 120 and the slit 118 and lift to initiate tearing along the line 110 as illustrated.

Figure 5:
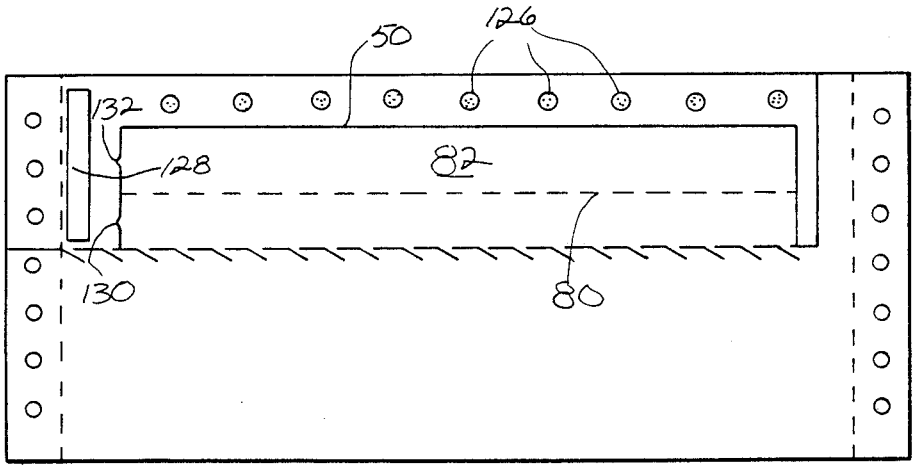
FIG. 5 is a view similar to FIG. 4 but with a tear strip removed to expose insert material and free the same from connection to the envelope.

Generally speaking, the glue 52 adhering the top and bottom plies 22, 24 and 26 together will be in the from of a series of discrete glue spots shown in FIGS. 4 and 5 as at 126 to form a releasable glue line as is well known in the art.

As can be seen in FIGS. 2, 4 and 5, an additional area of hot spot carbon 128 is located on the side of the ply 22 facing the ply 26 and specifically, the part 106 of the stub 92 of the ply 26. The hot spot carbon area 128 may be applied at that location at the same time as the hot spot carbon 66 is being applied but the same is not used for image transfer purposes. Rather, as can be seen in FIG. 2, the glue line 58 interconnecting the plies 22 and 26 is placed on the hot spot carbon area 128 rather than being directly connected to the paper forming the ply 22. As a consequence, the conventional glue used in business forms of this type, which forms a relatively strong bond between directly glued pieces of paper or the like forms a relatively weak bond because of the waxy nature of the hot spot carbon 128. If desired, the area 128 may also be formed of CF-CB or CFB material, varnish or ink, so long as it is less porous than the paper substrate. Consequently, the adhesion at this area is relatively easily broken. Thus, when the tear strip 124 is removed, the strong glue bond formed by the lines 60, 62 and 64 will result in the parts 106 of the stubs 92 of each of the interior plies 26, 28 and 30 being carried with the tear strip as the ties 94, 96 and 104 readily rupture. The weak bond formed as a result of the presence of the hot spot carbon 128 assures that the tear strip 124 may be removed sufficiently so as to break all of the aforementioned ties and thereby free the insert material while exposing the same as can be seen in FIG. 5. The ruptured ties 94 and 98 are shown at 130 and 132, respectively and are so small that the recipient of the mailing will generally be unaware of the existence of any connection of the insert material to the outer envelope as is employed for registration purposes.

Those skilled in the art should recognize that a number of advantages result from the foregoing. As the tear line 110 is being followed by a tear in the ply 24, any tendency of the tear to wander off of the line as it crosses from the base 114 of one Y-shaped cut 112 to the adjacent Y-shaped cut will be intercepted by one or the other of the arms 116 of the immediate down-the-line Y-shaped cut 112. Consequently, a reliable tear that will always follow the line is defined by the invention.

The unique application of conventional glue to an area of hot spot carbon 128 to provide a weak bond has a number of advantages. Firstly, the weak bond assures that the tear strip can be completely removed to assure disconnection of the insert material from the remainder of the envelope in the specific embodiment illustrated. A large advantage results in manufacturing because a weak adhesion is uniformly present because of the less porous nature of the hot spot carbon, thereby providing a high degree of reliability in terms of the weak bond breaking as desired. But other advantages are present as well. Heretofore, to uniformly achieve a reliable weak bond, frequently has been necessary to utilize a so-called fugitive glue or the like. In the case of a business form structure such as disclosed herein, this would require two types of glue, one at the area of hot spot carbon 128 which would be of the fugitive glue type to provide a weak bond, and the other a conventional glue elsewhere in the form to provide the strong bonds necessary to maintain envelope integrity as it passes through the mail. This of course complicates the assembly procedure and is avoided according to the present invention. It is to be particularly noted that essentially no effort is expended in adding the hot spot carbon 128 since hot spot carbon shown at 66 for image transfer purposes is going to be applied to the underside of the top ply 22 in any event; and it is an easy matter to extend such application to the bonding area to be covered by hot spot carbon as shown at 128. Thus, it will be readily appreciated that the invention accomplishes the objectives of providing a reliable tear strip as well simplifying manufacturing processes.

What is claimed is:

1. A continuous business form envelope assembly comprising top and bottom elongated plies defining fronts and backs of a series of connected envelopes;

at least one intermediate elongated ply between said top and bottom plies defining insert material within each of the series of connected envelopes, said intermediate ply being die cut at intervals along its length to define openings through which adhesive may extend to join said top and bottom plies and define upper and lower individual envelope edges;

one longitudinal marginal edge of said intermediate ply being adhered to said top and bottom plies along corresponding longitudinal marginal edges thereof;

at least one line of perforation extending across the bottom ply to define a tear strip that may be removed to partly expose said intermediate ply, one end of said tear strip being adhered to one side of part of said one longitudinal marginal edge of said intermediate ply, the other side of said part being adhered to the top ply via a less porous material on the latter;

said parts being separated from the remainder of said one longitudinal marginal edge by a line of weakening and connected to the remainder of said intermediate ply by one or more frangible connections which serve to register said remainder between said top and bottom plies;

said remainder of said intermediate ply otherwise being free of connection to said one longitudinal marginal edge;

whereby removal of said tear strip from an envelope will remove said part by reason of it being adhered to said tear strip and only weakly adhered to said top ply because of said less porous material, and thereby will rupture said frangible connection and expose and free said insert material within the envelope for extraction therefrom.

2. The continuous business form envelope assembly of claim 1 further including hot spot carbon between said top and intermediate plies to provide for image transfer to said intermediate ply upon impact printing, said less porous material being formed of hot spot carbon.

3. The continuous business form envelope assembly of claim 1 wherein said line of perforation is defined by aligned Y-shaped cuts.

4. The continuous business form envelope assembly of claim 3 wherein the base of each Y-shaped cut is disposed between the arms of an adjacent Y-shaped cut.

5. A continuous business form envelope assembly comprising:

top and bottom elongated plies defining fronts and backs of a series of connected envelopes;

at least one intermediate elongated ply between said top and bottom plies defining insert material within each of the series of connected envelopes, said intermediate ply being die cut at intervals along its length to define openings through which adhesive may extend to join said top and bottom plies and define upper and lower individual envelope edges;

hot spot carbon on said top ply facing said intermediate ply for transfer of impact printing images thereto;

one longitudinal marginal edge of said intermediate ply being adhered to said top and bottom plies along corresponding longitudinal marginal edges thereof;

at least one line of perforation defined by a series of aligned, Y-shaped cuts extending across the bottom ply and intersected by a slit in the bottom ply to define a tear strip that may be removed to partly expose said intermediate ply, one end of said tear strip being adhered to one side of part of said one longitudinal marginal edge of said intermediate ply, the other side of said part being adhered to the top ply via an area of hot spot carbon on the latter;

said part being separated from the remainder of said one longitudinal marginal edge by line of weakening and connected to the remainder of said intermediate ply by one or more frangible connections which serve to register said remainder between said top and bottom plies;

said remainder of said intermediate ply otherwise being free of connection to said one longitudinal marginal edge;

whereby removal of said tear strip from an envelope will remove said part by reason of it being adhered to said tear strip and only weakly adhered to said top ply because of said hot spot carbon and thereby will rupture said frangible connection and expose and free said insert material within the envelope for extraction therefrom.

6. In a multiple ply business form having first and second superimposed plies or sheets of paper;

hot spot carbon, CB or CFB material on a side of said first ply or sheet facing said second ply or sheet and including an area whereby images impacted on said first ply or sheet will be transmitted to the second ply or sheet, and adhesive releasably joining at least parts of said first and second plies or sheets at a location remote from said area;

the improvement wherein additional hot spot carbon, CB or CFB material is placed on said side at said location and said adhesive extends between said additional material and said second ply or sheet to form a weak, releasable adhesive bond thereat.

7. The multiple ply business form of claim 6 wherein said adhesive, at points other than said location, extends directly between said first and second plies or sheets to form a strong adhesive bond at said points.

8. The continuous business form envelope assembly of claim 1 wherein there are a plurality of said intermediate plys.

9. The continuous business form envelope assembly of claim 5 wherein there are a plurality of said intermediate plys.

* * * * *